US010364696B2

(12) United States Patent
Virkler

(10) Patent No.: US 10,364,696 B2
(45) Date of Patent: Jul. 30, 2019

(54) MECHANISM AND METHOD FOR RAPID RESPONSE CLEARANCE CONTROL

(71) Applicant: United Technologies Corporation, Farmington, CT (US)

(72) Inventor: Scott D. Virkler, Ellington, CT (US)

(73) Assignee: United Technologies Corporation, Farmington, CT (US)

( * ) Notice: Subject to any disclaimer, the term of this patent is extended or adjusted under 35 U.S.C. 154(b) by 686 days.

(21) Appl. No.: 15/151,274

(22) Filed: May 10, 2016

(65) Prior Publication Data

US 2017/0328230 A1 Nov. 16, 2017

(51) Int. Cl.

| | |
|---|---|
| ***F01D 11/22*** | (2006.01) |
| ***F01D 21/00*** | (2006.01) |
| ***F01D 25/24*** | (2006.01) |
| ***F04D 27/00*** | (2006.01) |
| ***F04D 29/16*** | (2006.01) |
| ***F04D 29/52*** | (2006.01) |

(52) U.S. Cl.

CPC ..... *F01D 11/22* (2013.01); *F01D 21/003* (2013.01); *F01D 25/24* (2013.01); *F04D 27/001* (2013.01); *F04D 29/164* (2013.01); *F04D 29/526* (2013.01); *F05D 2220/32* (2013.01); *F05D 2240/30* (2013.01); *F05D 2260/30* (2013.01); *F05D 2260/56* (2013.01)

(58) Field of Classification Search

CPC ..... F01D 11/20; F01D 11/22; F01D 25/24; F01D 21/003

USPC ..... 415/128, 173.2

See application file for complete search history.

(56) References Cited

U.S. PATENT DOCUMENTS

| | | | | |
|---|---|---|---|---|
| 3,085,398 A * | 4/1963 | Ingleson | F01D 11/22 415/127 |
| 4,714,404 A | 12/1987 | Lardellier | |
| 5,228,828 A * | 7/1993 | Damlis | F01D 11/22 415/173.2 |
| 5,601,402 A * | 2/1997 | Wakeman | F01D 11/22 415/173.1 |

(Continued)

FOREIGN PATENT DOCUMENTS

| | | |
|---|---|---|
| GB | 2108591 A | 5/1983 |
| WO | WO 2015-114059 * | 2/2015 |

(Continued)

OTHER PUBLICATIONS

Extended European Search Report for EP Application No. 17170274.9, dated Sep. 29, 2017, 8 pages.

*Primary Examiner* — Jason D Shanske
*Assistant Examiner* — Aye S Htay
(74) *Attorney, Agent, or Firm* — Kinney & Lange, P.A.

(57) ABSTRACT

A clearance control assembly for providing clearance control between a blade outer air seal and an airfoil tip of a gas turbine engine includes an outer case, a first blade outer air seal carrier, a blade outer air seal, an actuator, a load-applying member, and a lever. The first blade outer air seal carrier is positioned radially inward of the outer case. The blade outer air seal is positioned radially inward of and mounted to the blade outer air seal carrier. The load-applying member is positioned to be acted upon by the actuator during operation of the actuator. The lever is connected to the case and is operably in contact with the load-applying member and the first blade outer air seal carrier.

18 Claims, 6 Drawing Sheets

(56) References Cited

U.S. PATENT DOCUMENTS

| | | | | |
|---|---|---|---|---|
| 7,874,793 | B2 * | 1/2011 | Razzell | F01D 11/22 415/126 |
| 8,475,118 | B2 * | 7/2013 | Mulcaire | F01D 11/24 415/134 |
| 2008/0131270 | A1 * | 6/2008 | Paprotna | F01D 11/20 415/173.2 |
| 2014/0271147 | A1 * | 9/2014 | Uskert | F01D 11/24 415/173.2 |
| 2015/0218959 | A1 | 8/2015 | Barb et al. | |
| 2016/0017743 | A1 | 1/2016 | Duguay | |
| 2016/0047258 | A1 | 2/2016 | Hall et al. | |
| 2016/0053628 | A1 | 2/2016 | Duguay | |
| 2016/0369644 | A1 * | 12/2016 | Blaney | F01D 25/246 |

FOREIGN PATENT DOCUMENTS

| | | | |
|---|---|---|---|
| WO | WO2015020708 | A2 | 2/2015 |
| WO | WO2015038906 | A1 | 3/2015 |

* cited by examiner

MECHANISM AND METHOD FOR RAPID RESPONSE CLEARANCE CONTROL

BACKGROUND

The present disclosure relates generally to blade outer air seals (BOAS) used in gas turbine engines, and more particularly to providing rapid response clearance control for the same.

Rotor tip clearance control is necessary for achieving improvements in turbomachinery efficiency and fuel consumption. It is desirable to minimize the clearance between a rotor tip and a static outer shroud seal (e.g., BOAS), while reducing the potential for tip rubbing during operation. This can be achieved by various means of active clearance control (ACC), which utilizes fluid, generally bleed air from a compressor exit and/or bypass duct of a gas turbine engine, to control the thermal expansion or contraction, and thereby the inner diameter, of an outer case. ACC is commonly used during cruising portions of a flight. Because thermal response can be slow, conventional ACC systems are generally not well suited to rapid throttle operations (e.g., snap accelerations, rapid re-accelerations, and maneuvers), which immediately add mechanical growth due to acceleration to the existing thermal growth of the rotor disk. During rapid throttle operations, the rotor and, in particular, the airfoil, can expand at a significantly higher rate than the case, requiring that tip clearances be set higher than desired to limit tip rubbing.

Clearance control assemblies capable of providing rapid response to thermal and mechanical growth are needed to reduce tip clearance during high throttle operations while reducing or preventing tip rub.

SUMMARY

In one aspect, a clearance control assembly for providing clearance control between a blade outer air seal and an airfoil tip of a gas turbine engine includes an outer case, a first blade outer air seal carrier, a blade outer air seal, an actuator, a load-applying member, and a lever. The first blade outer air seal carrier is positioned radially inward of the outer case. The blade outer air seal is positioned radially inward of and mounted to the blade outer air seal carrier. The load-applying member is positioned to be acted upon by the actuator during operation of the actuator. The lever is connected to the case and is operably in contact with the load-applying member and the first blade outer air seal carrier.

In another aspect, a method of controlling a clearance between a blade outer air seal and an airfoil tip of a gas turbine engine includes pivoting a lever operably in contact with an axially extending surface of a blade outer air seal or a blade outer air seal carrier and moving the blade outer air seal in relation to the airfoil tip. The lever is pivoted to adjust the radially outward force applied against the axially extending member. The lever is pivoted to 1) increase a radially outward force applied to the axially extending surface or 2) reduce a radially outward force applied to the axially extending surface. The blade outer air seal is 1) lifted in relation to the airfoil tip or 2) lowered in relation to the airfoil tip.

In yet another aspect, a clearance control assembly for providing clearance control between a blade outer air seal and an airfoil tip of a gas turbine engine includes an outer case having axially separated first and second hooks, a blade outer air seal, an actuator, a load-applying member, and a lever. The first and second hooks are positioned radially inward of the outer case. The blade outer air seal is positioned radially inward of the outer case and has third and fourth hooks. The third hook is positioned between the first hook and the inner surface of the outer case and the fourth hook is positioned between the second hook and the inner surface of the outer case. The load-applying member is positioned to be acted upon by the actuator during operation of the actuator. The lever is connected to the case and operably in contact with the load-applying member and an axially extending surface of the blade outer air seal.

The present summary is provided only by way of example, and not limitation. Other aspects of the present disclosure will be appreciated in view of the entirety of the present disclosure, including the entire text, claims and accompanying figures.

Figure 1:
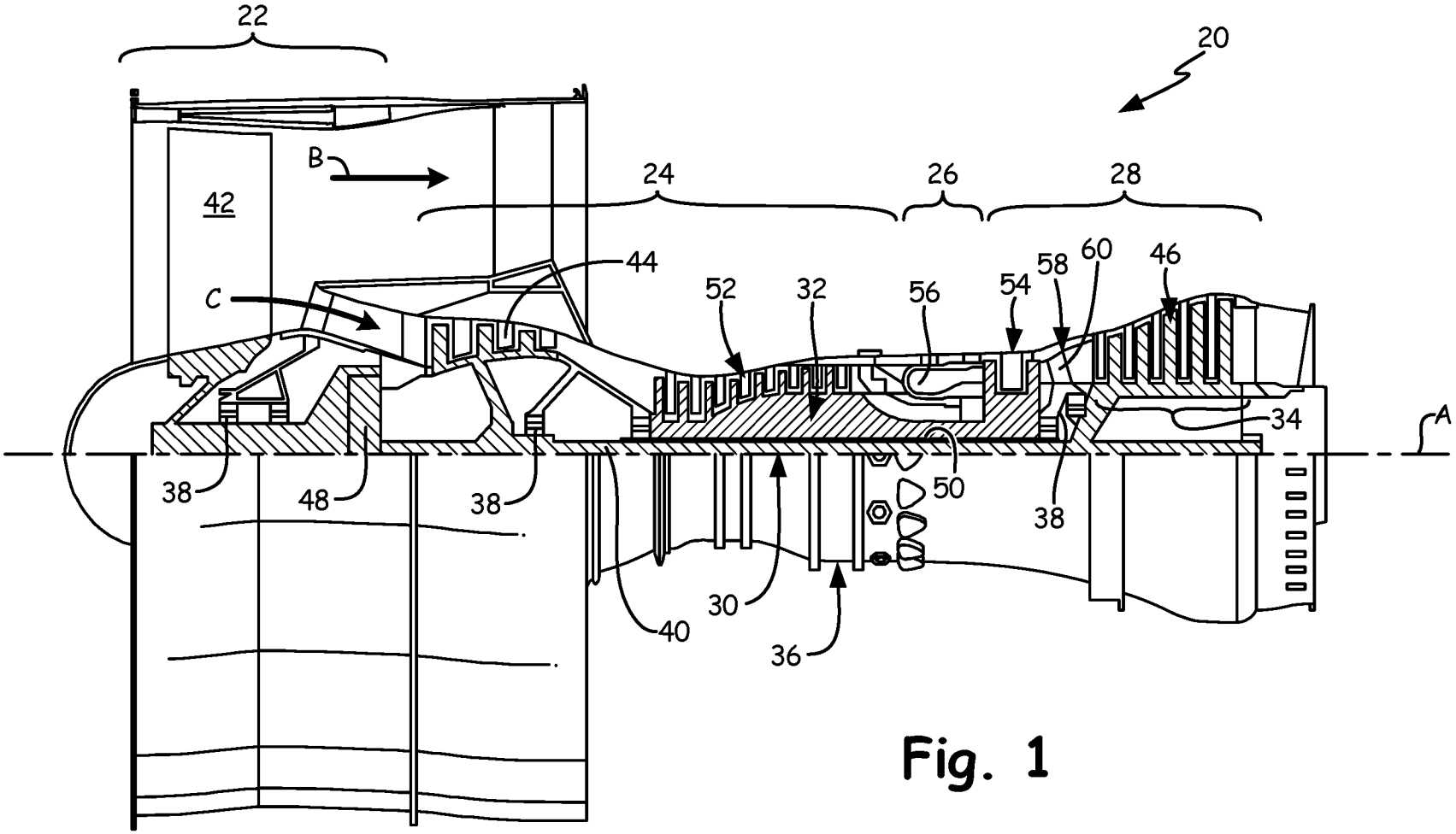
FIG. 1 is a quarter-sectional view of a gas turbine engine.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

FIG. 1 is a quarter-sectional view of a gas turbine engine 20 that includes fan section 22, compressor section 24, combustor section 26 and turbine section 28. Alternative engines might include an augmenter section (not shown) among other systems or features. Fan section 22 drives air along bypass flow path B while compressor section 24 draws air in along core flow path C where air is compressed and communicated to combustor section 26. In combustor section 26, air is mixed with fuel and ignited to generate a high pressure exhaust gas stream that expands through turbine section 28 where energy is extracted and utilized to drive fan section 22 and compressor section 24.

Although the disclosed non-limiting embodiment depicts a turbofan gas turbine engine, it should be understood that the concepts described herein are not limited to use with turbofans as the teachings may be applied to other types of turbine engines; for example a low-bypass turbine engine, or a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes low speed spool 30 and high speed spool 32 mounted for rotation about an engine central longitudinal axis A relative to an engine static structure 36 via several bearing systems 38. It should be understood that various bearing systems 38 at various locations may alternatively or additionally be provided.

Low speed spool 30 generally includes inner shaft 40 that connects fan 42 and low pressure (or first) compressor section 44 to low pressure (or first) turbine section 46. Inner shaft 40 drives fan 42 through a speed change device, such as geared architecture 48, to drive fan 42 at a lower speed than low speed spool 30. High-speed spool 32 includes outer shaft 50 that interconnects high pressure (or second) compressor section 52 and high pressure (or second) turbine section 54. Inner shaft 40 and outer shaft 50 are concentric and rotate via bearing systems 38 about engine central longitudinal axis A.

Combustor 56 is arranged between high pressure compressor 52 and high pressure turbine 54. In one example, high pressure turbine 54 includes at least two stages to provide a double stage high pressure turbine 54. In another example, high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of low pressure turbine 46 as related to the pressure measured at the outlet of low pressure turbine 46 prior to an exhaust nozzle.

Mid-turbine frame 58 of engine static structure 36 is arranged generally between high pressure turbine 54 and low pressure turbine 46. Mid-turbine frame 58 further supports bearing systems 38 in turbine section 28 as well as setting airflow entering low pressure turbine 46.

The core airflow C is compressed by low pressure compressor 44 then by high pressure compressor 52 mixed with fuel and ignited in combustor 56 to produce high speed exhaust gases that are then expanded through high pressure turbine 54 and low pressure turbine 46. Mid-turbine frame 57 includes airfoils/vanes 60, which are in the core airflow path and function as an inlet guide vane for low pressure turbine 46. Utilizing vanes 60 of mid-turbine frame 58 as inlet guide vanes for low pressure turbine 46 decreases the length of low pressure turbine 46 without increasing the axial length of mid-turbine frame 58. Reducing or eliminating the number of vanes in low pressure turbine 46 shortens the axial length of turbine section 28. Thus, the compactness of gas turbine engine 20 is increased and a higher power density may be achieved.

Each of the compressor section 24 and the turbine section 28 can include alternating rows of rotor assemblies and vane assemblies (shown schematically) that carry airfoils that extend into the core flow path C. To improve efficiency, static outer shroud seals (not shown), such as a blade outer air seal (BOAS), can be located radially outward from rotor airfoils to reduce tip clearance and losses due to tip leakage.

Figure 2:
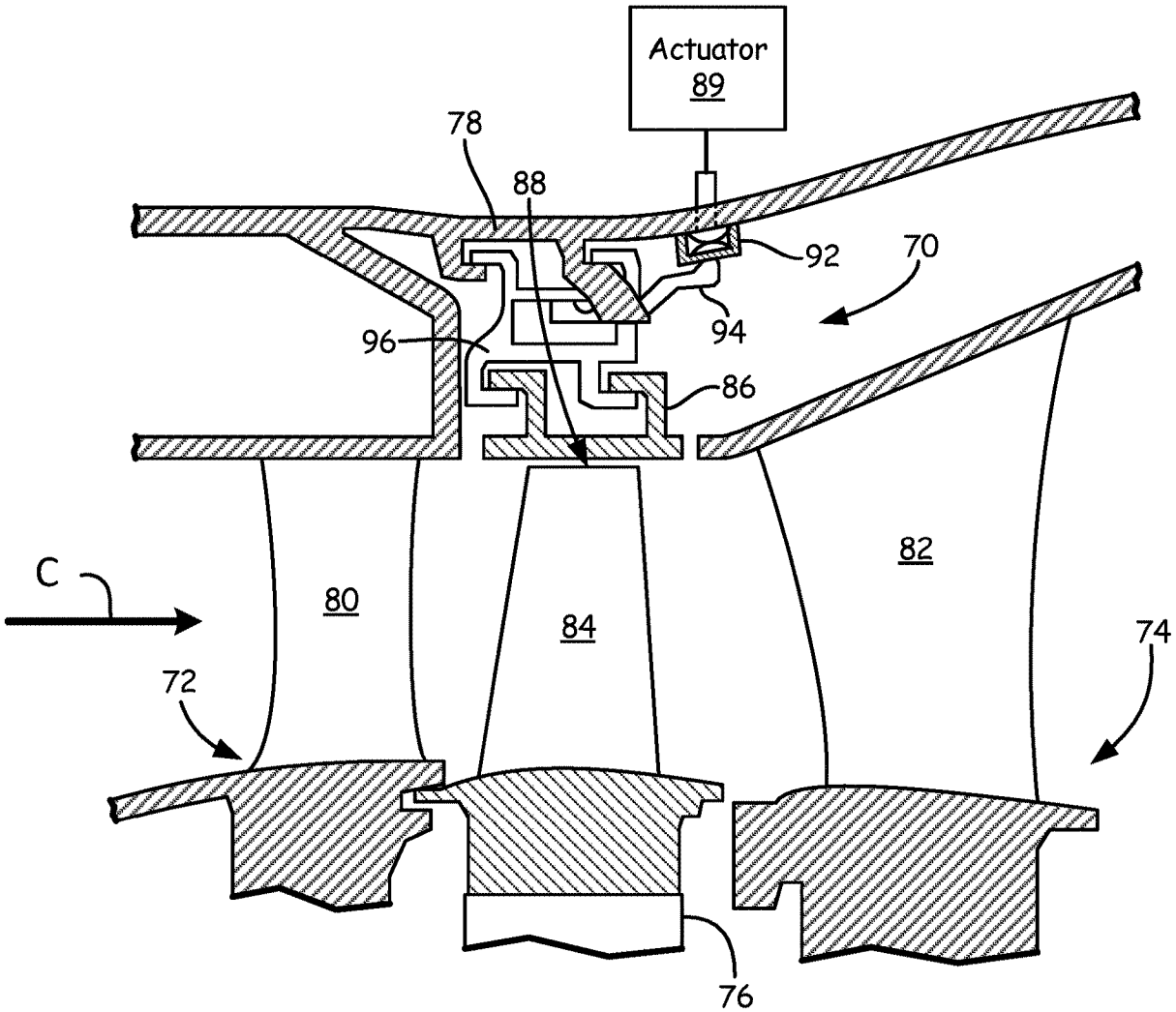
FIG. 2 is a schematic view of a portion of the gas turbine engine with a clearance control assembly.

FIG. 2 illustrates a portion of a gas turbine engine, such as, but not limited to, gas turbine engine 20 of FIG. 1, having clearance control assembly 70. The portion of the gas turbine engine illustrated in FIG. 2 is intended to be non-limiting. It will be understood by one skilled in the art that clearance control assembly 70 can be installed in both compressor and turbine sections (24, 28) of gas turbine engine 20 or other gas turbine engines. The portion of the gas turbine engine illustrated in FIG. 2 has stator assemblies 72 and 74, rotor 76, and case 78. Stator assemblies 72 and 74 can each have a plurality of airfoils 80 and 82, respectively, to direct core airflow C. Rotor 76 can have a plurality of airfoils 84 to create or extract energy from core airflow. Case 78 can be an annular ring configured to house stator assemblies 72 and 74, rotor 76, and clearance control assembly 70. Clearance control assembly 70 can include a static outer shroud seal or BOAS 86 configured to reduce core airflow leakage across rotor tip 88, an actuator 89, load-applying member 92, and lever 94. Clearance control assembly 70 can optionally include seal carrier 96, as shown in FIG. 2. BOAS 86 can be located radially inward of case 78 and radially outward of rotor tip 88. Conventionally, a plurality of segmented BOAS 86 can be used, collectively forming a ring around rotor 76 to seal multiple airfoils 84. As illustrated in FIG. 2, BOAS 86 can be mounted to seal carrier 96, which can be positioned between case 78 and BOAS 86. Seal carrier 96 can be an annular ring or a segment configured to receive one or more BOAS 86. A plurality of seal carriers 96 can form a segmented ring within an inner diameter of case 78. In an alternative embodiment, BOAS 86 can be mounted to case 78 directly (illustrated in FIG. 6).

During operation of the gas turbine engine, rotor 76 and airfoil 84 can expand radially outward due to increased temperatures and centrifugal load. Static components, such as case 78 and stator assemblies 72 and 74, as well as clearance control assembly 70, can also experience thermal growth. The rate of thermal expansion for each component can vary significantly, with the rate of thermal expansion of airfoil 84 generally being greater than the rate of thermal expansion of both rotor 76 and case 78. Clearance control assembly 70 can be used to adjust the radial position of BOAS 86 to minimize clearance between BOAS 86 and rotor tip 88, while limiting the potential for tip rub against BOAS 86. Lever 94 can be used to apply a radially outward force against seal carrier 96 to cause seal carrier 96 and thereby BOAS 86 to move radially outward away from rotor tip 88. Clearance control assembly 70 can provide rapid response to a changes in tip clearance due to variations in the thermal environment and centrifugal load of rotor 76 and airfoil 84. The ability to provide rapid response is particularly important during high throttle operations, such as snap accelerations, rapid re-accelerations, and maneuvers, which immediately add mechanical growth due to acceleration to the existing thermal growth of rotor 76 and airfoil 84. Without a rapid response mechanism for clearance control during high throttle operations, tip clearances must be set sufficiently high to avoid the detrimental effects of tip rub under different operational conditions. Setting high clearances to avoid tip rub during high throttle operations results in reduced efficiency due to increased tip leakage during lower throttle operations (e.g., during a cruise portion of a flight). A plurality of clearance control assemblies 70 can be positioned circumferentially around and within case 78 to control rotor tip clearance between each rotor tip 88 and BOAS 86. While FIG. 2 illustrates a mechanism for providing rapid response clearance control, it will be understood by one skilled in the art that traditional active clearance control (ACC) mechanisms (not shown), but particularly suited to the cruising portion of a mission, can be optionally used in addition to clearance control assembly 70.

Figure 3:
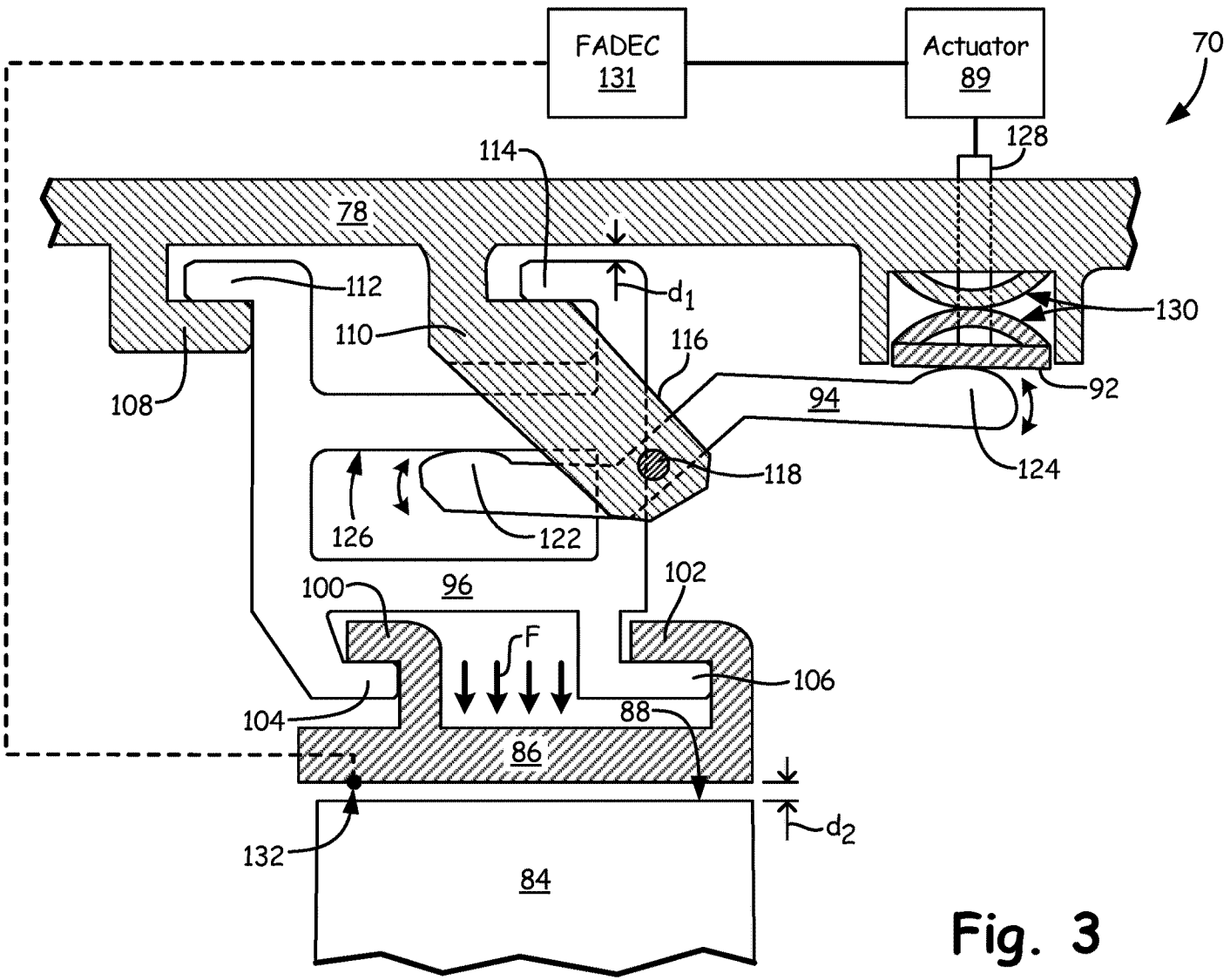
FIG. 3 is a cross-sectional view of the clearance control assembly in a first position.
Figure 4:
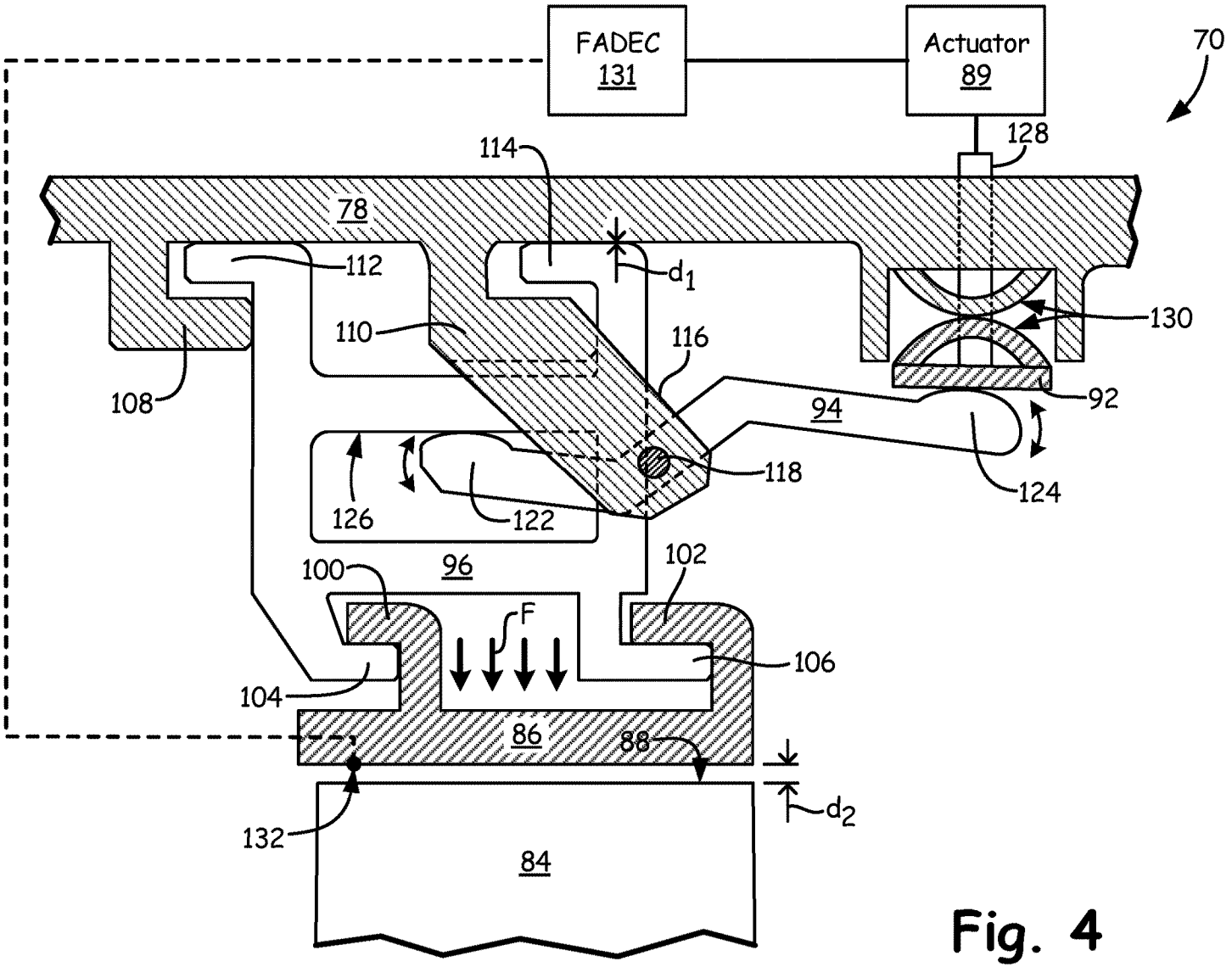
FIG. 4 is a cross-sectional view of the clearance control assembly in a second position.

FIGS. 3 and 4 are cross-sectional views of the clearance control assembly 70 of FIG. 2. FIG. 3 illustrates BOAS 86 located in a radially innermost position. FIG. 4 illustrates BOAS 86 in a radially outermost position. As illustrated in FIGS. 3 and 4, BOAS 86 has forward and aft hooks 100 and 102, respectively, which can be mounted into respective forward and aft hooks 104 and 106 of seal carrier 96. Hooks 100 and 102 can extend radially outward from BOAS 86, while hooks 104 and 106 can extend radially inward from seal carrier 96. Each BOAS 86 can have a plurality of hooks 100 and 102, and each seal carrier 96 can have a plurality of mating hooks 104 and 106. As illustrated in FIGS. 3 and 4, hooks 100 and 102 can face forward, while hooks 104 and 106 can face aftward; however, it will be understood by one skilled in the art that the orientation of hooks 100, 102, 104, and 106, as well as the position can be modified as needed to optimize mounting for operation or to improve ease of assembly and disassembly. Ease of assembly is particularly important for BOAS 86 as well as seal carriers 96 in the turbine section of the gas turbine engine where exposure to high temperature gas flow from the combustor limits the lifetime of the parts and necessitates periodic replacement. However, while the hook-style mounts illustrated in FIGS. 3 and 4 can increase ease of assembly, it will be understood by one skilled in the art that other fastening mechanisms can be used (e.g., nut, bolt, screw, rivet, weld). A secondary cooling airflow (not shown) can provide a biasing force (F) that biases BOAS 86 to seal carrier 96 during operation of the gas turbine engine. Therefore, fastening mechanisms in addition to hooks 100, 102, 104, and 106 are unnecessary to secure BOAS 86 to seal carrier 96.

Seal carrier 96 can be mounted to case 78 in a similar fashion to how BOAS 86 is mounted to seal carrier 96. Case 78 can have radially inward extending hooks 108 and 110, which can receive radially outward extending hooks 112 and 114 of seal carrier 96. As illustrated in FIGS. 3 and 4, hooks 112 and 114 can be located in a forward and aft portion on seal carrier 96. Seal carrier 96 can include a plurality of hooks 112 and 114 configured to mount into a plurality of mating hooks 108 and 110. Hooks 108 and 110 can extend substantially congruent with an inner surface of the outer case. As illustrated in FIGS. 3 and 4, hooks 108 and 110 face aftward, while hooks 112 and 114 face forward. It will be understood by one skilled in the art that the orientation and positioning of hooks 108, 110, 112, and 114 can be modified to optimize stability during operation and improve ease of assembly and disassembly. A space, labeled as distance $d_1$ in FIGS. 3 and 4 can allow for the radially outward movement of seal carrier 96, and thereby BOAS 86, which is enabled by the use of the non-fixed hook-style mounting illustrated in FIGS. 3 and 4. For certain applications, distance $d_1$ can range from approximately 0.5-1.8 mm (0.02-0.07 inches). However, it will be understood by one skilled in the art that distance $d_1$ can vary depending on the scale of the engine, magnitude of maneuvers and amount of interaction to due to re-acceleration closedown.

Seal carrier 96, and thereby BOAS 86, can be moved radially outward by lever 94 when lever 94 is acted upon by load-applying member 92. Lever 94 can be secured to (or relative to) case 78. Case 78 can include connection member 116, which can attach to lever 94 at fulcrum 118. As illustrated in FIGS. 3 and 4, connection member 116 can extend radially inward from a lateral surface of hook 110. Connection member 116 can be integrally formed with hook 110 or can be a separate element secured by a fastener (e.g., nut, bolt, rivet, screw, weld). Although in the illustrated embodiment, the position of hook 110 is suitable for locating connection member 116 relative to fulcrum 118, in alternative embodiments, connection member 116 can extend from hook 108 or another portion of case 78. For segmented seal carriers 96, connection member 116 can be located on a hook adjacent an edge of seal carrier 96, such that connection member 116 can extend into a gap between adjacent to seal carriers 96. While connection member 116 can secure lever 94 to case 78, lever 94 is free to pivot about fulcrum 118 to move seal carrier 96 and BOAS 86.

Lever 94 can have opposite ends 122 and 124. End 122 can be radially inward of and operably in contact with axial extending surface 126 (e.g., of seal carrier 96). End 124 can be operably in contact with load-applying member 92. During operation, load-applying member 92 can be acted upon by plunger 128, which can be controlled by actuator 89 outside of case 78. Use of lever 94 allows for the positioning of actuator 89 and associated case penetration points outside of the rotor blade containment section. In this manner, clearance control assembly 70 does not compromise the rotor blade containment section of the gas turbine engine. Additionally, use of lever 94 can provide mechanical advantage based on the position of fulcrum 118 and reduce actuation loads as compared to other actuator controlled clearance control systems. FIGS. 3 and 4 illustrate actuator 89 (e.g., solenoid, hydraulic, or other suitable linear actuator) with plunger 128, which extends through case 78. In alternative embodiments, actuator 89 can be a rotational actuator operably connected to a cam or other mechanism capable of moving load-applying member 92.

Actuator 89 can be selectively operated (by suitable controls) to cause plunger 128 to extend and retract. During extension, plunger 128 acts on load-applying member 92, which in turn applies a radially inward force on lever end 124, causing lever 94 to pivot about fulcrum 118. When plunger 128 is retracted, load-applying member 92 and lever 94 are returned to a primary position. Biasing member 130, which can include one or more coil springs, Belleville washers, or other type of biasing members as known in the art, can be used to provide a minimal load throughout the travel range of load-applying member 92 to help avoid a zero load condition and limit vibration and rocking of lever 94. Low friction bushings or rolling element bearings can additionally be employed to reduce friction. Lever ends 122 and 124 can have a crowned, spherical, or cylindrical outer contact surface which can roll upon axially extending surface 126 and load-applying member 92, respectively, when lever 94 pivots. The crowned surfaces can reduce friction that would be associated with movement of flat surfaces against axially extending surface 126 and load-applying member 92. The position of fulcrum 118 can be set based on balancing moments. The point to which lever 94 axially extends along axially extending surface 126 can be set to limit rocking. Lever 94 should be capable of moving seal carrier 96 without significantly rocking seal carrier 96.

As lever 94 pivots, lever end 122 can apply a radially outward force on axially extending surface 126 of seal carrier 96. The radially outward force can lift or move seal carrier 96 radially outward, which in turn lifts or moves BOAS 86 away from rotor tip 88 to prevent tip rub. As illustrated in FIG. 4, when seal carrier 96 is in a radially outermost position, hooks 112 and 114 of seal carrier 96 can contact an inner surface of case 78, reducing distance $d_1$ to approximately zero. The radial position of seal carrier 96 is limited by hooks 108 and 110 and the inner surface of case 78. However, the radial position of seal carrier hooks 112 and 114 within the space between hooks 108 and 110 and case 78 is not limited. In other words, seal carrier 96 can be positioned in a radially innermost position, a radially outermost position, and any radial position therebetween. Generally, the radially innermost position can accommodate cruising portions of a mission, while the radial outermost position accommodates various high throttle operations or maneuvers. Radial positions therebetween can be appropriate for operations that do not require full radially outward movement, but require some degree of radially outward movement to avoid tip rub.

Radial positions of seal carrier 96 can be preset based on known conditions in the gas turbine engine. In such case, actuator 89 can be in communication with a full authority digital electronic control system (FADEC) 131 or other dedicated control system, which can initiate operation of actuator 89 according to known tip clearance requirements based on operating temperatures (thermal environment) and engine acceleration or speed. For example, during a rapid acceleration, FADEC 131 can communicate with actuator 89 to position seal carrier 96 in a predetermined radial position based on earlier testing analysis. The predetermined radial position may or may not provide the optimum tip clearance if the position is a conservative value selected from a range of values obtained during testing. Alternatively, FADEC 131 can be in communication with sensors embedded within various components of clearance control assembly 70. Sensors can include, but are not limited to, capacitance probes, which can measure the distance between two components in real time. For example, sensor 132 can be used to determine tip clearance, shown as $d_2$ in FIGS. 3 and 4, when embedded in a radially inner surface of BOAS 86. Use of sensors can enable real-time feedback for clearance control to optimize tip clearance throughout all operations of the gas turbine engine and improve efficiency.

Figure 5:
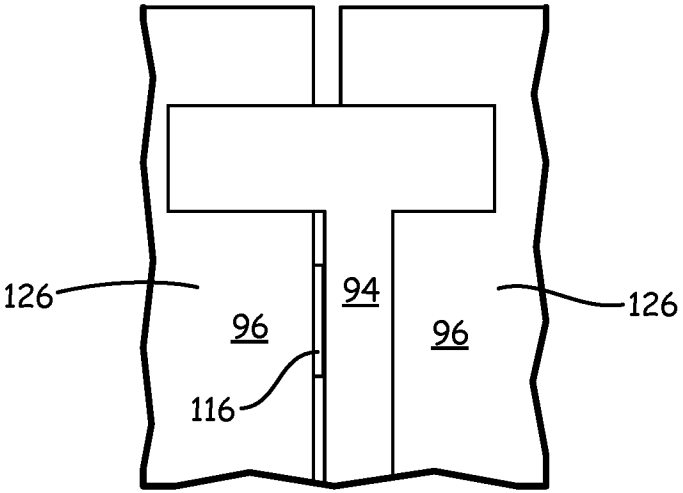
FIG. 5 is a cross-sectional view of another embodiment of the clearance control assembly.

A plurality of clearance control assemblies can be positioned around the circumference and within case 78 to control tip clearance. Generally, one lever 94 can be used to control the radial position of one or more BOAS 86. Each of the plurality of seal carriers 96 can hold one or more BOAS 86 and each lever 94 can act upon one or more seal carriers 96. FIG. 5 illustrates a schematic view of lever 94 looking radially outward from a position radially inward of lever 94. Lever 94 can have a T-shape, which enables lever 94 to contact axially extending surfaces 126 of adjacent seal carriers 96. In this manner, one lever 94 can be positioned between each pair of seal carriers 96. When pivoted simultaneously and to the same position, levers 94 can limit rocking of seal carriers 96 and BOAS 86.

Figure 6:
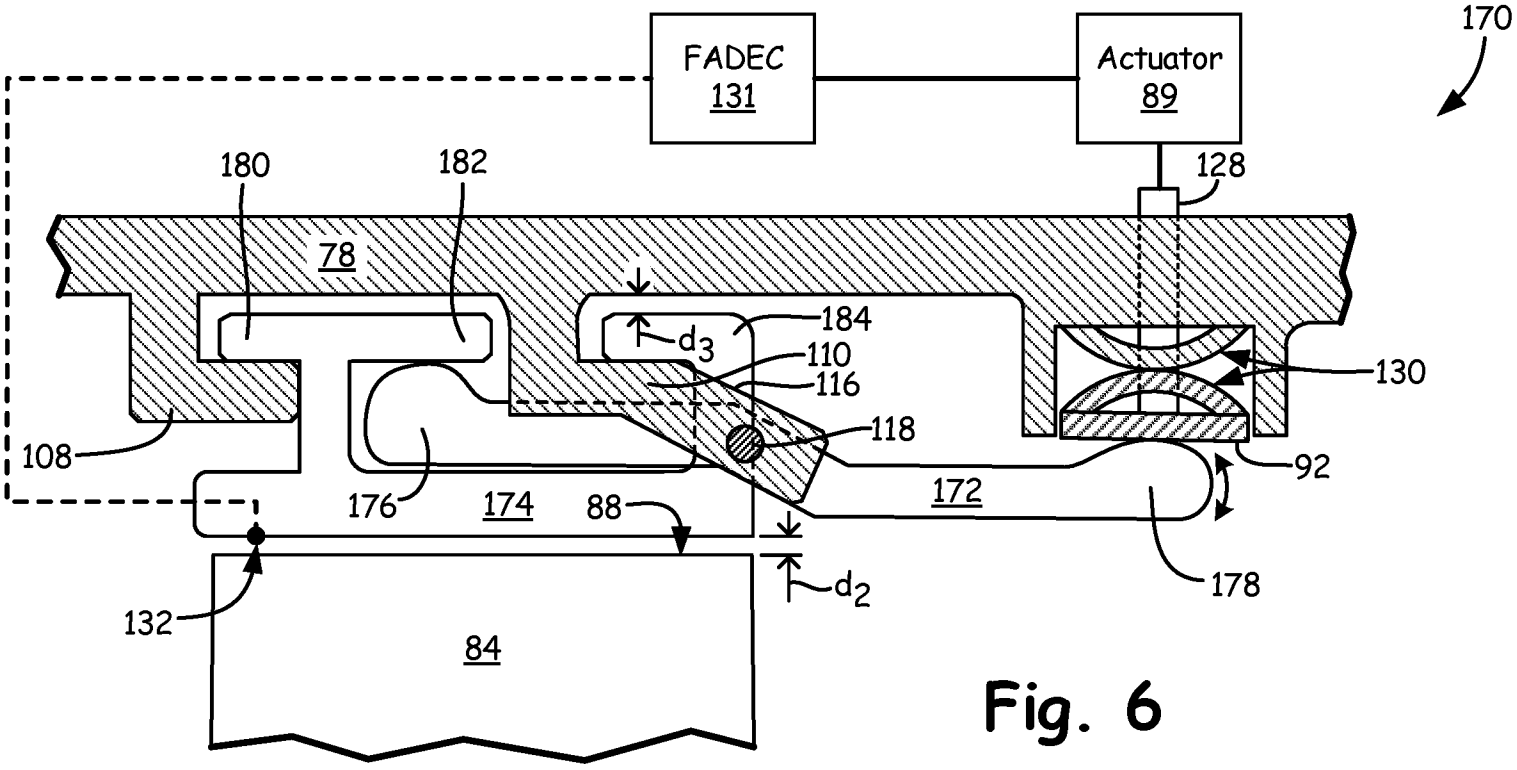
FIG. 6 is a schematic view of a portion of the clearance control assembly.

FIG. 6 illustrates seal assembly 170, which is an alternative embodiment of clearance control assembly 70. Clearance control assembly 170 operates in similar fashion to clearance control assembly 70 without use of seal carrier 96. As illustrated in FIG. 6, lever 172 acts on BOAS 174 directly. Similar to lever 94 illustrated in FIGS. 3 and 4, lever 172 has opposite ends 176 and 178, which have crowned, spherical, or cylindrical surfaces for contacting inner radial surfaces of BOAS 174 and load-applying member 92, respectively. Lever 172 can have a slightly different shape than lever 94 suited to the differences orientation and positioning of surrounding structures. Lever 172 can be connected to connecting member 116 at fulcrum 118. Connecting member can extend from case hook 110 or other suitable structure connected with case 78.

BOAS 174 can have three hooks (180, 182, and 184) as opposed to two hooks as disclosed in FIGS. 3 and 4. Hooks 180 and 182 can form a T-shape adjacent the forward end of BOAS 174, which extends radially outward from BOAS 174. Hook 180 can face forward and hook 182 can face aftward. Hook 184 can be positioned on an aft end of BOAS 174, extending radially outward from BOAS 174 and facing forward. Hooks 180 and 184 can be received by hooks 108 and 110, respectively, of case 78, with a space between an outer surface of hooks 180, 182 and 184 and an inner surface of case 78, the distance of the space being identified as $d_3$ in FIG. 6. As load applying member 92 exerts a radially inward force on lever end 178, lever 172 pivots about fulcrum 118 and exerts a force on an inner radial surface of BOAS hook 182, forcing BOAS 174 radially outward and away from rotor tip 88. As described for clearance control assembly 70, sensors, such as sensor 132 can be embedded in the inner radial surface of BOAS 174 to measure in real-time rotor tip clearance ($d_2$). Sensors 132 can be in communication with FADEC 131, which can control actuator 89 to move BOAS 174 based on real-time feedback throughout the operation of the gas turbine engine. Real-time feedback and control can enable system optimization, including tip clearance, and improved efficiency.

Clearance control assemblies 70 and 170 can provide rapid response to rapid changes in operation of a gas turbine engine. Rapid response clearance control can improve efficiency by minimizing rotor tip clearance ($d_2$) and tip leakage, while preventing detrimental tip rub. Use of levers 94 and 178 can enable the positioning of actuators and associated case penetration points outside of the rotor blade containment structure to improve structural integrity and operation and can reduce actuation loads, by locating fulcrum 118 to achieve mechanical advantage. Sensors 132 and FADEC 131 can be incorporated into clearance control assemblies 70 and 170 to provide real-time feedback and control, which can result in additional gains in efficiency.

DISCUSSION OF POSSIBLE EMBODIMENTS

The following are non-exclusive descriptions of possible embodiments of the present invention.

A clearance control assembly for providing clearance control between a blade outer air seal and an airfoil tip of a gas turbine engine includes an outer case, a first blade outer air seal carrier, a blade outer air seal, an actuator, a load-applying member, and a lever. The first blade outer air seal carrier is positioned radially inward of the outer case. The blade outer air seal is positioned radially inward of and mounted to the blade outer air seal carrier. The load-applying member is positioned to be acted upon by the actuator during operation of the actuator. The lever is connected to the case and is operably in contact with the load-applying member and the first blade outer air seal carrier.

The clearance control assembly of the preceding paragraph can optionally include, additionally and/or alternatively, any one or more of the following features, configurations and/or additional components:

A further embodiment of the foregoing clearance control assembly, wherein the lever can be connected to the outer case at a fulcrum.

A further embodiment of any of the foregoing clearance control assemblies, wherein the lever can have first and second ends separated by the fulcrum, and wherein at least one of the first and second ends can include a crowned surface extending radially outward A further embodiment of any of the foregoing clearance control assemblies, wherein the first end of the lever can be operably in contact with an inner radial surface of the load-applying member and the second end can be operably in contact with an axially extending portion of the first blade outer air seal carrier.

A further embodiment of any of the foregoing clearance control assemblies can further include first and second hooks, a connection member, and third and fourth hooks. The first and second hooks can be positioned radially inward of the outer case. The connection member can extend from the second hook to the lever and can be attached to the lever at the fulcrum. The third and fourth hooks can be positioned radially outward of the first blade outer air seal carrier and can be mounted into the first and second hooks, such that the third hook is positioned between the first hook and the inner surface of the outer case the fourth hook is positioned between the second hook and the inner surface of the outer case.

A further embodiment of any of the foregoing clearance control assemblies, wherein the third and fourth hooks of the first blade outer air seal carrier can contact inner axially extending surfaces of the first and second hooks of the outer case when the lever is in a first position.

A further embodiment of any of the foregoing clearance control assemblies, wherein the third and fourth hooks of the first blade outer air seal carrier can contact the inner surface of the outer case when the lever is in a second position.

A further embodiment of any of the foregoing clearance control assemblies, wherein inner and outer radial surfaces of the third and fourth hooks of the first blade outer air seal carrier can be radially displaced from the inner axially extending surfaces of the first and second hooks and the inner surface of the outer case, respectively, when the lever is in a third position.

A further embodiment of any of the foregoing clearance control assemblies can further include a spring element positioned between the outer case and the load-applying member.

A further embodiment of any of the foregoing clearance control assemblies can further include a second blade outer air seal carrier positioned circumferentially adjacent to the first blade outer air seal carrier, and wherein the lever can be positioned operably in contact with a portion of each of the first and second blade outer air seal carriers.

A further embodiment of any of the foregoing clearance control assemblies can further include a sensor to obtain at least one measurement, which can include distance between the blade outer air seal and the airfoil tip, radial displacement of the blade outer air seal, radial displacement of the blade outer air seal carrier, and combinations thereof.

A method of controlling a clearance between a blade outer air seal and an airfoil tip of a gas turbine engine includes pivoting a lever operably in contact with an axially extending surface of a blade outer air seal or a blade outer air seal carrier and moving the blade outer air seal in relation to the airfoil tip. The lever is pivoted to adjust the radially outward force applied against the axially extending member. The lever is pivoted to 1) increase a radially outward force applied to the axially extending surface or 2) reduce a radially outward force applied to the axially extending surface. The blade outer air seal is 1) lifted in relation to the airfoil tip or 2) lowered in relation to the airfoil tip.

The method of the preceding paragraph can optionally include, additionally and/or alternatively, any one or more of the following features, configurations and/or additional steps:

A further embodiment of the foregoing method can further include obtaining a measurement, which can include distance between the blade outer air seal and the airfoil tip, radial displacement of the blade outer air seal, radial displacement of the blade outer seal carrier, and combinations thereof, and providing the measurement to a control unit. The step of pivoting the lever to adjust the radially outward force applied against the axially extending surface can be done in response to the measurement obtained.

A clearance control assembly for providing clearance control between a blade outer air seal and an airfoil tip of a gas turbine engine includes an outer case having axially separated first and second hooks, a blade outer air seal, an actuator, a load-applying member, and a lever. The first and second hooks are positioned radially inward of the outer case. The blade outer air seal is positioned radially inward of the outer case and has third and fourth hooks. The third hook is positioned between the first hook and the inner surface of the outer case and the fourth hook is positioned between the second hook and the inner surface of the outer case. The load-applying member is positioned to be acted upon by the actuator during operation of the actuator. The lever is connected to the case and operably in contact with the load-applying member and an axially extending surface of the blade outer air seal.

The clearance control assembly of the preceding paragraph can optionally include, additionally and/or alternatively, any one or more of the following features, configurations and/or additional components:

A further embodiment of the foregoing clearance control assembly, wherein the lever can include a first end having a crowned surface extending radially outward, a second end having a crowned surface extending radially outward, and a fulcrum positioned between the first and second ends. The fulcrum can be attached to a connection member extending from the second hook of the outer case.

A further embodiment of the foregoing clearance control assembly, wherein the third and fourth hooks of the blade outer air seal can contact radial surfaces of the first and second hooks of the outer case when the lever is in a first position and can contact the inner surface of the outer case when the lever is in a second position.

A further embodiment of the foregoing clearance control assembly can further include a second blade outer air seal positioned radially inward of the outer case. The second blade outer air seal can have an axially extending surface. The lever can be operably in contact with the axially extending surfaces of the first and second blade outer air seals.

A further embodiment of the foregoing clearance control assembly can further include a spring positioned between the outer case and the load-applying member.

A further embodiment of the foregoing clearance control assembly can further include a sensor to obtain at least one measurement, which can include distance between the blade outer air seal and the airfoil tip, radial displacement of the blade outer air seal, and combinations thereof.

SUMMATION

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A clearance control assembly for providing clearance control between a blade outer air seal and an airfoil tip of a gas turbine engine, the clearance control assembly comprising:

an outer case comprising a connection member extending from a radially inner surface of the outer case;

a first blade outer air seal carrier positioned radially inward of the outer case;

a blade outer air seal positioned radially inward of and mounted to the first blade outer air seal carrier;

an actuator;

a load-applying member positioned radially inward of the outer case and configured to be acted upon by the actuator during operation of the actuator; and a lever connected to the connection member of the outer case at a fulcrum, the lever comprising a first end operably in contact with the load-applying member and a second end operably in contact with the first blade outer air seal carrier, the first and second ends separated by the fulcrum.

2. The clearance control assembly of claim 1, wherein at least one of the first and second ends comprises a crowned surface extending radially outward.

3. The clearance control assembly of claim 2, wherein the crowned surface of the first end of the lever is operably in contact with a radially inner surface of the load-applying member and the crowned surface of the second end is operably in contact with an axially extending portion of the first blade outer air seal carrier.

4. The clearance control assembly of claim 3 further comprising:

first and second hooks, wherein the first and second hooks are positioned radially inward of the outer case, wherein the connection member extends from the second hook to the lever; and third and fourth hooks, wherein the third and fourth hooks extend radially outward of the first blade outer air seal carrier and are mounted into the first and second hooks, such that the third hook is positioned between the first hook and the inner surface of the outer case the fourth hook is positioned between the second hook and the inner surface of the outer case.

5. The clearance control assembly of claim 4, wherein the third and fourth hooks of the first blade outer air seal carrier contact inner axially extending surfaces of the first and second hooks of the outer case when the lever is in a first position.

6. The clearance control assembly of claim 4, wherein the third and fourth hooks of the first blade outer air seal carrier contact the inner surface of the outer case when the lever is in a second position.

7. The clearance control assembly of claim 4, wherein inner and outer radial surfaces of the third and fourth hooks of the first blade outer air seal carrier are radially displaced from the inner axially extending surfaces of the first and second hooks and the inner surface of the outer case, respectively, when the lever is in a third position.

8. The clearance control assembly of claim 1, further comprising:

a spring element positioned between the outer case and the load-applying member.

9. The clearance control assembly of claim 1, further comprising:

a second blade outer air seal carrier positioned circumferentially adjacent to the first blade outer air seal carrier, and wherein the lever is positioned operably in contact with a portion of each of the first and second blade outer air seal carriers.

10. The clearance control assembly of claim 1, further comprising:

a sensor to obtain at least one measurement selected from the group consisting of distance between the blade outer air seal and the airfoil tip, radial displacement of the blade outer air seal, radial displacement of the blade outer air seal carrier, and combinations thereof.

11. A method of controlling a clearance between a blade outer air seal and an airfoil tip of a gas turbine engine, the method comprising:

pivoting a lever connected to an outer case and operably in contact with a load-applying member at a first end of the lever and an axially extending surface of at least one of a blade outer air seal and a blade outer air seal carrier at a second end of the lever to adjust a radially outward force applied against the axially extending surface, wherein pivoting the lever results in at least one of 1) increasing a radially outward force applied to the axially extending surface and 2) reducing a radially outward force applied to the axially extending surface; and moving the blade outer air seal in relation to the airfoil tip, wherein moving the blade outer air seal comprises at least one of the steps including 1) lifting the blade outer air seal in relation to the airfoil tip and 2) lowering the blade outer air seal in relation to the airfoil tip;

wherein the outer case has axially separated first and second hooks positioned radially inward of the outer case to engage third and fourth hooks of the one of the blade outer air seal and a blade outer air seal carrier, and wherein a connection member extending from the second hook is attached to the lever at a fulcrum.

12. The method of claim 11, further comprising:

obtaining a measurement selected from the group consisting of distance between the blade outer air seal and the airfoil tip, radial displacement of the blade outer air seal, radial displacement of the blade outer seal carrier, and combinations thereof;

providing the measurement to a control unit; and wherein pivoting the lever to adjust the radially outward force applied against the axially extending surface is done in response to the measurement obtained.

13. The method of claim 11, wherein pivoting the lever causes the blade outer air seal to move to a position selected from the group consisting of an innermost radial position, an outermost radial position, and a middle radial position, wherein the middle radial position comprises any radial position between the innermost and outermost radial positions.

14. A clearance control assembly for providing clearance control between a blade outer air seal and an airfoil tip of a gas turbine engine, the clearance control assembly comprising:

an outer case having axially separated first and second hooks, the first and second hooks positioned radially inward of the outer case;

a first blade outer air seal positioned radially inward of the outer case and having third and fourth hooks, the third hook being positioned between the first hook and a radially inner surface of the outer case and the fourth hook being positioned between the second hook and the radially inner surface of the outer case;

an actuator;

a load-applying member positioned to be acted upon by the actuator during operation of the actuator; and a lever connected to the outer case and operably in contact with the load-applying member and an axially extending surface of the blade outer air seal, wherein the lever comprises:

a first end having a crowned surface extending radially outward;

a second end having a crowned surface extending radially outward; and a fulcrum positioned between the first and second ends, wherein the fulcrum is attached to a connection member extending from the second hook of the outer case.

15. The clearance control assembly of claim 14, wherein the third and fourth hooks of the blade outer air seal contact radial surfaces of the first and second hooks of the outer case when the lever is in a first position and contact the radially inner surface of the outer case when the lever is in a second position.

16. The clearance control assembly of claim 14, further comprising:

a second blade outer air seal positioned radially inward of the outer case and having an axially extending surface, wherein the lever is operably in contact with the axially extending surfaces of the first and second blade outer air seals.

17. The clearance control assembly of claim 14, further comprising:

a spring positioned between the outer case and the load-applying member.

18. The clearance control assembly of claim 14, further comprising:

a sensor to obtain at least one measurement selected from the group consisting of distance between the blade outer air seal and the airfoil tip, radial displacement of the blade outer air seal, and combinations thereof.

* * * * *